United States Patent [19]

Lopez

[11] Patent Number: 4,511,079

[45] Date of Patent: Apr. 16, 1985

[54] VARIABLE DIMENSION CONTAINER

[75] Inventor: Louis Lopez, Leominster, Mass.

[73] Assignee: Container Corporation of America, Chicago, Ill.

[21] Appl. No.: 548,238

[22] Filed: Nov. 3, 1983

[51] Int. Cl.[3] ..... B65D 5/22

[52] U.S. Cl. ..... 229/34 R; 206/45.16; 206/586; 229/33

[58] Field of Search ..... 229/16 R, 33, 34 R, 229/34 B, 34 HW; 206/453, 586, 45.14, 45.16, 45.19, 814

[56] References Cited

U.S. PATENT DOCUMENTS

| | | | |
|---|---|---|---|
| 1,703,042 | 2/1929 | Kondolf | 229/16 R |
| 2,090,200 | 8/1937 | Hekman | 206/45.16 |
| 2,307,146 | 1/1943 | McCash et al. | 206/45.16 |
| 2,637,481 | 5/1953 | Adams, Sr. | 206/45.14 X |
| 2,979,251 | 4/1961 | Frisosky et al. | 206/45.14 X |
| 4,326,633 | 4/1982 | Schillinger et al. | 206/586 X |

FOREIGN PATENT DOCUMENTS

| | | | |
|---|---|---|---|
| 1066597 | 6/1954 | France | 229/16 R |
| 1358615 | 3/1964 | France | 206/45.16 |
| 2344254 | 11/1977 | France | 206/45.14 |
| 646195 | 9/1962 | Italy | 229/33 |

*Primary Examiner*—William Price
*Assistant Examiner*—Gary E. Elkins
*Attorney, Agent, or Firm*—Richard W. Carpenter

[57] ABSTRACT

A one-piece collapsible paperboard container having internal panels which may be folded in alternate positions to accommodate varying the inner dimensions of the container for the packaging of articles of varying sizes.

3 Claims, 5 Drawing Figures

VARIABLE DIMENSION CONTAINER

BACKGROUND OF THE INVENTION

1. Field of the Invention:

This invention relates generally to paperboard containers, and more particularly to a container which may be erected in alternate forms so as to vary an inner dimension of the container and thereby accommodate the alternate packing of articles of different sizes.

2. Description of the Prior Art:

A prior art search in the United States Patent and Trademark Office directed to the subject matter of this application disclosed the following U.S. Pat. Nos.: 685,977; 2,678,766; 2,793,801; 2,845,211; 2,989,223; 3,330,465; 3,924,801.

None of the prior art uncovered in the search discloses a container having a structure like that of the present invention which includes anchor flaps extending inwardly from the end walls of the container and which may be selectively positioned either flat along the bottom wall panel of the box, or folded up at an angle with the end walls and locked in an inclined position, in order to vary an inner dimension of the container.

SUMMARY OF THE INVENTION

An object of the present invention is to provide a new and improved one-piece collapsible container formed of paperboard and including inner panels which may be folded in alternate ways to vary an inner dimension of the container to accommodate the packaging of articles of different sizes such as shoes.

A more specific object of the invention is the provision of a one-piece paperboard container having end walls with inner anchor panels extending therefrom whicy may be folded in alternate positions to vary an inner dimension of the container.

These and other objects of the invention will be apparent from an examination of the following description and drawings.

It will be understood that, for purposes of clarity, certain elements may have been omitted from certain views where they are believed to be illustrated to better advantage in other views.

DESCRIPTION OF THE PREFERRED EMBODIMENT

Figure 1:
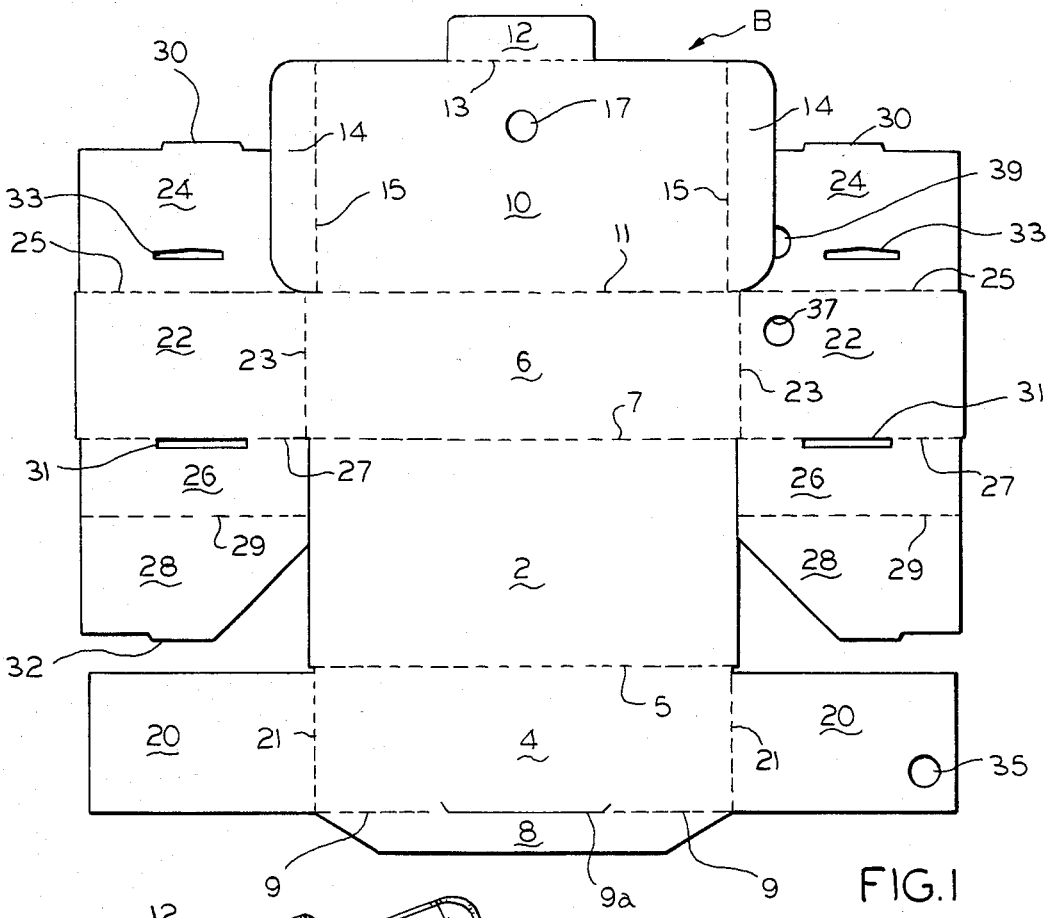
FIG. 1 is a plan view of a blank of foldable sheet material from which the container illustrated in the other views may be formed.
Figure 2:
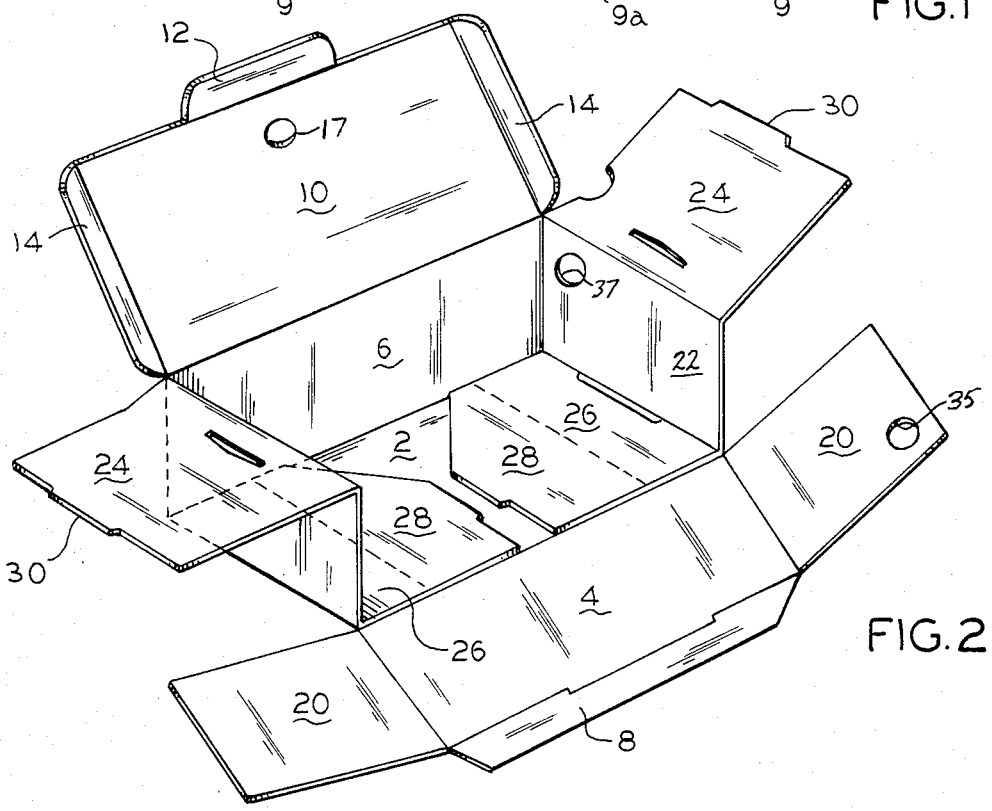
FIG. 2 is a fragmentary perspective view illustrating one step in the formation of the container shown in the other views from the blank illustrated in FIG. 1.
Figure 3:
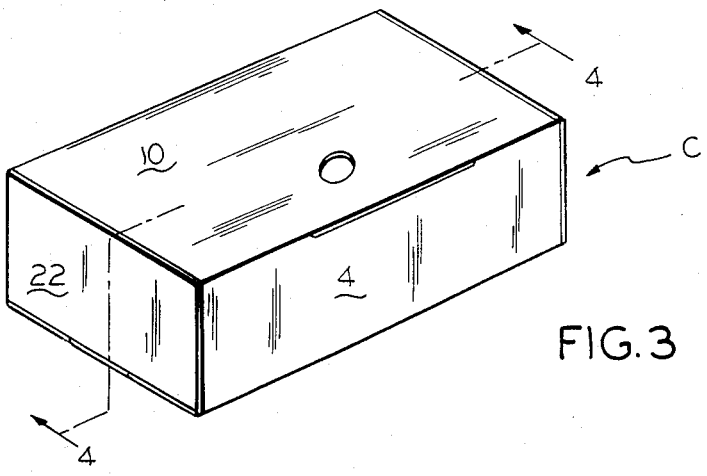
FIG. 3 is a perspective view of a container embodying features of the invention, as shown in the erected and closed condition.

Referring now to the drawings for a better understanding of the invention, it will be seen that the novel container, indicated generally at C and illustrated in FIG. 3, may be formed from the unitary blank B of foldable sheet material, such as paperboard, illustrated in FIG. 1.

The container includes a central body section having a bottom wall panel 2 and an opposed front and rear side wall panels 4 and 6 foldably joined to front and rear edges of bottom wall panel 2 on fold lines 5 and 7, respectively, and extending upwardly therefrom.

A relatively narrow front closure flap 8 is foldably joined by a pair of spaced, aligned score lines 9 to the upper edge of front wall panel 8. Score lines 9 are separated from each other by a cut line 9*a* which serves to receive a locking tongue 12 as described later in the specification.

A top or cover panel 10 is foldably joined on fold line 11 to the upper edge of rear wall 6 and has foldably joined to its forward edge, in fold line 13, the previously referred to locking tab or tongue 12 which is adapted to be received within front wall slit 9*a* when the container is closed condition. A pair of relatively narrow side closure or tuck flaps 14 are foldably joined to opposite ends of top wall panel 10 along parallel fold lines 15. Top wall panel 10 may also be provided with a finger hole 17 adapted to facilitate opening of the container.

The end wall construction of the container is rather unique and is the area wherein the novelty of the present invention resides. Each of the end walls of the container include an intermediate panel 20 which is foldably joined on fold 21 to adjacent end edge of front wall panel 4. Each end wall also includes an outer panel 22 which is foldably joined on fold line 23 to an adjacent end edge of rear side wall panel 6 and an inner panel 24 which is foldably joined on a fold line 25 to an upper edge of end wall outer panel 22. When the carton is erected intermediate panel 20 is sandwiched between end wall outer panel 22 and end wall inner panel 24.

The primary purpose of the invention is to provide a container the inner dimension of which may be varied to accommodate packaging of articles of different sizes, such as men's or ladies'shoes. In order to accomplish this there is provided at each end of the container an anchor panel which includes a pair of first and second panel sections 26 and 28, respectively.

Anchor panel inner section 26 is foldably joined at its outer edge on fold line 27 to a lower edge of related end wall outer panel 22. Anchor panel second section 28 is foldably joined at its outer edge along fold line 29 to the inner edge of related first section 26. When the carton is folded into erected position the end walls are locked into position so as not to require the use of any outside securing means such as glue or staples. This is accomplished by providing at the lower edges of end wall inner panels 24 integral lock tabs 30 which may be received within related slots or openings 31 presented by anchor panel first sections 26.

As previously mentioned, the purpose of the anchor panels is to vary the inner dimension of the container. If it is desired to have the maximum inner dimension for the container both sections of the anchor panel are folded so as to lie in face-to-face relation with the upper surface of bottom wall panel 2 as shown in the left-hand side of FIG. 5.

Figure 5:
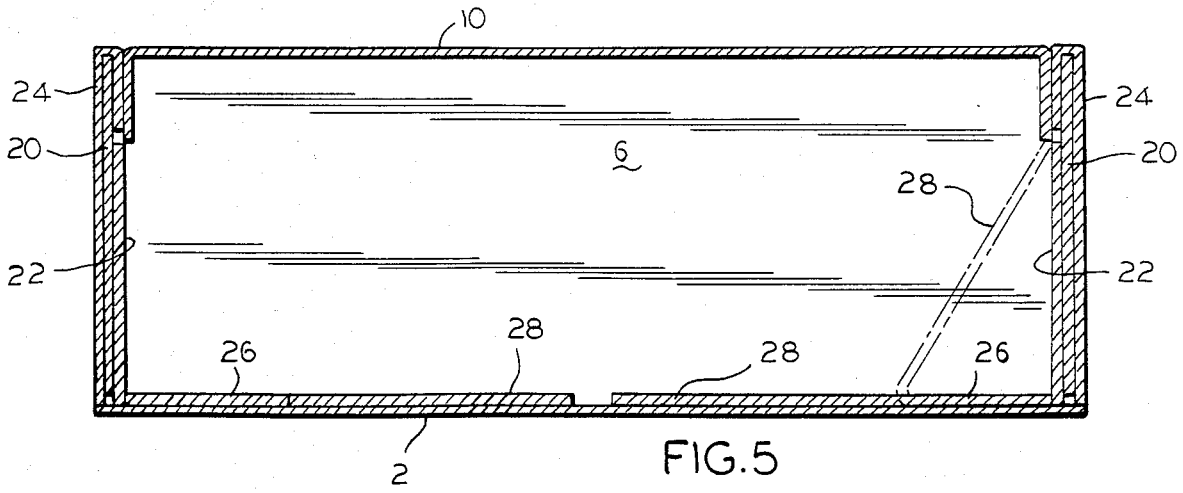

If it is desired to have a shorter dimension one of the anchor panel outer sections 28 may be folded upwardly and outwardly, as shown in the right-hand side of FIG. 5, with lock tab 32 being received within slot 33 presented by the related inner end wall panel 24.

Figure 4:
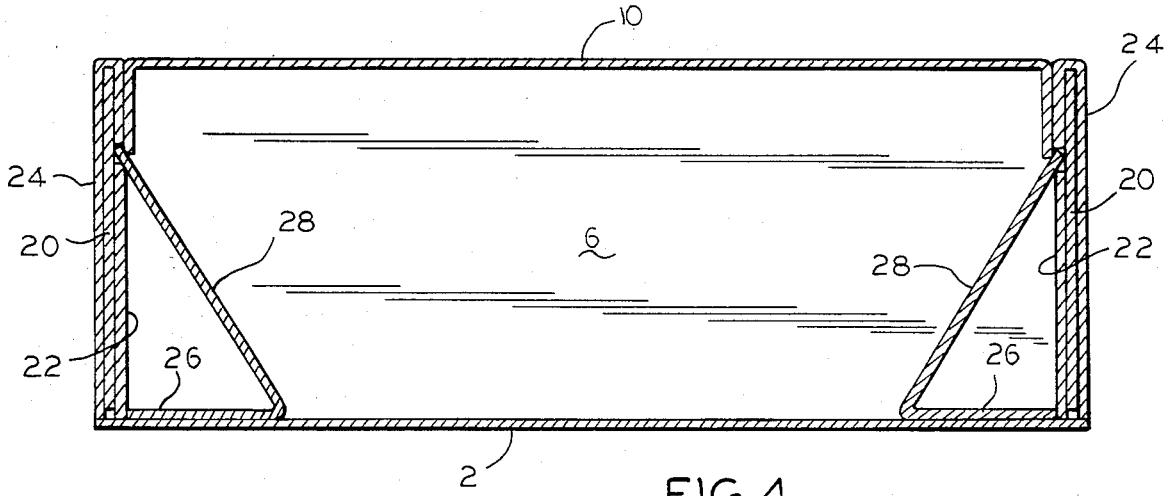
FIGS. 4 and 5 are sectional views taken along the line 4—4 of FIG. 3 and illustrate alternate folding arrangements for inner panels of the container to accommodate varying an inner dimension of the container for packaging articles of different sizes.

A third arrangement is illustrated in FIG. 4 wherein both of the anchor panel second sections 28 are folded upwardly and outwardly and secured to the end walls in a manner previously described.

Also, in order to facilitate removal of the box from a shelf, the end walls may be provided with openings, 35, 37, and 39 in panels 20, 22, 24, respectively, which are aligned with each other to provide a common finger hole grasping for the end wall.

Thus, it will be seen that the invention provides a unique design for a container which may be erected in various ways to accomodate the packaging of articles of varying sizes.

What is claimed is:

1. A self-contained, variable inner dimension, collapsible container formed from a unitary blank of foldable sheet material, such as paperboard, comprising:

(a) a bottom wall panel;

(b) front and rear side wall panels foldably joined to and upstanding from front and rear side edges of said bottom wall panel;

(c) a pair of opposed end walls each including:

(i) an intermediate panel foldably joined to an end edge of one of said side wall panels;

(ii) an outer panel foldably joined to an end edge of the other of said side wall panels;

(iii) an inner panel foldably joined to an upper edge of said outer panel;

(d) means for varying an inner dimension of said container, to accomodate alternate packaging of items of different lengths, said means including a pair of anchor panels extending inwardly from respective end wall outer panels;

(e) each of said anchor panels including:

(i) a first panel section foldably joined at its outer edge to a lower edge of a related end wall and disposed to overlie an adjacent end portion of said bottom wall panel;

(ii) a second panel section foldably joined at its outer edge to an adjacent inner edge of said first panel section and adapted alternately to either overlie said bottom wall panel or be folded upwardly and outwardly to extend over said first section to said related end wall inner panel to shorten an inner dimension of said container.

2. A container according to claim 1, wherein said end wall intermediate panel is sandwiched between said end wall outer and inner panels and wherein said inner panel has a lock tab which is receivable within an opening of a related anchor panel first section.

3. A container according to claim 1, wherein each of said anchor panel second sections has a lock tab which is receivable within an opening of a related end wall inner panel.

* * * * *